United States Patent [19]

Villarreal et al.

[11] Patent Number: 4,623,683

[45] Date of Patent: Nov. 18, 1986

[54] FABRIC FINISH WITH ALPHA OLEFIN RESINS AND PROCESS

[75] Inventors: John G. Villarreal; Calvin J. Verbrugge; Fred J. Reichley, all of Racine County, Wis.

[73] Assignee: S.C. Johnson & Son, Inc., Racine, Wis.

[21] Appl. No.: 659,979

[22] Filed: Oct. 12, 1984

[51] Int. Cl.[4] ..... C08J 00/00

[52] U.S. Cl. ..... 524/47; 524/52; 524/211; 524/502; 524/506

[58] Field of Search ..... 524/47, 52, 211, 502, 524/506

[56] References Cited

U.S. PATENT DOCUMENTS

| | | | |
|---|---|---|---|
| 3,488,311 | 1/1970 | Burdick et al. | 524/517 |
| 3,644,241 | 2/1972 | Falirene | 524/50 |
| 3,723,375 | 3/1973 | Field et al. | 260/29.6 |
| 3,833,393 | 9/1974 | Kandathil | 106/212 |
| 4,038,027 | 7/1977 | Kearney | 427/393.1 |
| 4,358,573 | 11/1982 | Verbrugge | 526/272 |

*Primary Examiner*—Joseph L. Schofer
*Assistant Examiner*—J. Reddick

[57] ABSTRACT

An aqueous fabric finishing composition includes a solubilized polymer of from 40 to 51 mole percent of a mixture of higher one-alkenes and from 60 to 49 mole percent maleic anhydride.

7 Claims, No Drawings

FABRIC FINISH WITH ALPHA OLEFIN RESINS AND PROCESS

BACKGROUND OF THE INVENTION

This invention is directed to novel compositions for imparting an enhanced fabric finish to textile materials. In particular, it relates to a readily applied fabric finish free of the defects of conventional spray starch compositions.

It has long been desired to improve the appearance, body and wearing qualities of textile materials. For example, pressurized liquid laundry starches have become widely utilized to stiffen clothing. Such laundry starches, as set forth in U.S. Pat. Nos. 3,644,241 and 3,833,393, are sprayed or sprinkled onto the fabric and ironed in to fix the starch on the fabric. Unfortunately, while starch is an effective stiffener, it also tends to build up on the iron sole during application. The dried starch is subject to flaking as white specks onto the fabric and is also subject to scorching, thereby discoloring the fabric as it is transferred to it. Further, starch does not impart water borne stain resistance to fabrics.

Other additives have been employed to assist conventional starch-containing compositions in imparting other desired characteristics to fabrics. For example, in U.S. Pat. No. 3,644,241 increased stain resistance is said to be obtained by using fluoropolymers, while in U.S. Pat. No. 3,833,393, wax is utilized to improve body and fabric softness.

Commercial fabric impregnants have been employed to enhance soil release and stain resistance of textiles as disclosed in U.S. Pat. Nos. 3,897,206 and 4,038,027. However, such impregnants, including copolymers of 1-hexene and maleic anhydride, are said to require use of esterification catalysts to chemically bond the copolymers to cellulosic groups in the fabric. The process is said to employ commercial padders and heavy duty dryers to provide curing and drying times up to one hour. Such procedures are totally unacceptable for consumer use. In addition, to impart other highly desired properties, such as wrinkle resistance, it is said to be necessary to treat the fabric with other permanent-press type additives in addition to the disclosed polymers.

Accordingly, it is an object of this invention to provide a fabric finishing composition adapted for consumer use and capable of imparting enhanced water-borne stain resistance, wrinkle resistance, brightening and whitening, and feel to fabrics without subjecting the fabric to deposit of flakes and scorching.

SUMMARY OF THE INVENTION

The above and other objects are met in an aqueous fabric finishing composition comprising a solubilized polymer of from about 40 to 51 mole percent of at least one higher 1-alkene and from about 60 to 49 mole percent of maleic anhydride.

In another aspect, a fabric finishing composition adapted to be applied to a fabric and fixed thereto by ironing is provided which comprises (a) a solubilized polymer of from about 40 to 51 mole percent of at least one higher 1-alkene and from about 60 to 49 mole percent of maleic anhydride and (b) a friction reducing and antifoam additive for reducing the tendency of said polymer to adhere to said iron and for reducing the tendency of said polymer to foam during application.

The fabric finishing composition may be rendered self-propelling by employing a propellant to facilitate application.

A process is also provided for imparting a fabric finish to a textile material comprising (a) applying to said material a fabric finishing composition of the invention to coat said fabric and (b) setting the coated finish employing heat and pressure.

As employed herein the phrase "higher 1-alkene" includes a 1-alkene having at least 10 carbon atoms.

It has been found that a solubilized polymer of the invention, when applied to textiles and textile garments and thereafter ironed, imparts thereto water resistance, water-borne stain resistance, wrinkle resistance, better feel and fabric brightening and whitening. During ironing, no flaking or scorching occurs. The finish imparted is substantive to the textile fabric, at least to the degree that such properties are present even after washing.

DETAILED DESCRIPTION OF THE INVENTION

The compositions of this invention contain an alpha olefin/maleic anhydride polymer. The alpha olefin is at least one higher 1-alkene. The higher 1-alkene has at least 10 carbon atoms. Such monomers are employed alone, or, more preferably as mixtures of higher 1-alkenes, such as mixed $C_{20}$, $C_{22}$, $C_{24}$ 1-alkenes and mixed $C_{30+}$ 1-alkenes. In a more preferred embodiment the 1-alkene is a mixture of (i) a $C_{10}$ to $C_{18}$ 1-alkene monomer and (ii) a $C_{30+}$ mixed 1-alkene monomer, and especially, a mixture of $C_{18}$ 1-alkene and $C_{30+}$ mixed 1-alkenes. Such monomer mixtures are polymerized with maleic anhydride monomer.

Waxy, alpha-olefin polymers of the invention are known to the art and have been disclosed in U.S. Pat. No. 4,240,916 and in U.S. Pat. No. 4,358,573, the disclosures of which are incorporated herein. It has been found that the alpha-olefin requires on the order of at least 10 carbon atoms to permit proper application. Polymers of 1-alkenes having less than ten carbon atoms and maleic anhydride tend to accumulate on the iron during fixing of the fabric finish. Fabric finished with such polymers tends to be unduly stiff, since 1-alkene monomers with less than 10 carbon atoms tend to produce polymers that are more glassy than waxy. In addition, it is believed that 1-alkene monomers with less than about 10 carbon atoms form polymers that are unduly hygroscopic and permit the fabric to absorb excess amounts of moisture.

The polymer of the invention also includes maleic anhydride, although it may be possible to employ other maleic anhydrides, such as methylmaleic anhydride, methylethyl maleic anhydride and the like.

Typical 1-alkene monomers used in this invention include such $C_{10}$–$C_{18}$ monomers as 1-decene
1-dodecene
1-tetradecene
1-hexadecene
1-octadecene.

Typical $C_{20}$–$C_{30+}$ 1-alkenes include:

1-eicosene
1-tetracosene
1-triacontene.

The polymers of the invention include from 40–51 mole percent of the higher 1-alkenes and 60–49% maleic anhydride. The preferred molar ratio of 1-alkene to maleic anhydride is about 1:1. Best results are obtained when the polymer is from 10–40 mole % of $C_{10}$–$C_{18}$ 1-alkene, 40–10 mole % of $C_{20}$–$C_{30+}$ 1-alkene and 60–49 mole % maleic anhydride.

In general, the polymer is employed in amounts sufficient to provide effective water resistance, water-borne stain resistance, feel wrinkle resistance and brightening and whitening. For this and other purposes usually from about 1–7% by weight of polymer is employed, more preferably from about 2.5 to 3.5% by weight, and most preferably, about 3% by weight. Unless otherwise indicated all weights are in % by weight based on the total weight of the aqueous composition.

The polymers of the invention are solubilized in an aqueous carrier, such as deionized water or tap water. For this purpose an aqueous base is required, at least a major amount thereof being comprised of an alkaline substance having a fugitive cation. The alkaline base can be ammonium hydroxide, sodium hydroxide, tetramethylammonium hydroxide, alkyl amines, morpholine, and the like; provided that at least a major amount of the alkaline substance contains a fugitive cation, such as ammonium ion. A preferred embodiment contains at least 50% ammonium hydroxide and, more preferably 100% ammonium hydroxide.

The aqueous base serves to cut the polymer into solution and stabilizes the resin in the aqueous composition. For most purposes, the amount of base employed is sufficient to dissolve or disperse the alkali-soluble polymer. In most cases, from about 0.2 to 2.0% by weight of base is employed, perferably from about 0.3 to 0.6% by weight and, most preferably, about 0.45% by weight.

The pH of the finishing compositions of the invention is adjusted by addition of said base to between about 7.5 and 9.6 for enhanced stability.

After application to the textile, the fabric finishing composition of the invention is subjected to heat and pressure by an iron to dry, cure or set the polymer to form a stable film thereon. It is believed that the polymer is primarily physically, not chemically, bound to the fabric or fibers of the textile.

Depending on such factors as the temperature of the iron, the pressure exerted by the iron on the fabric, polymer concentration in the finishing composition and amount of polymer applied to the textile, it has been found that, under certain circumstances, portions of the polymer film can be partially removed by passage of the iron. The film so removed builds up under the sole of the iron and acts to increase friction between the iron and the fabric. In addition, it has also been found that the alpha olefinic resins of the invention tend to foam upon their pressurized discharge from an aerosol can.

Accordingly, it is preferred to provide a friction reducing additive in the composition to aid the iron in gliding over the fabric finish. It is also preferred to employ an antifoaming additive to prevent undesired foam from forming on the fabric, thereby preventing formation of a uniform polymer finish or film. It has been discovered that a single additive can be employed to reduce friction and foam. That additive is sometimes referred to as an ironing aid.

The most preferred ironing aids are silicones having good release properties. Typical silicones include dimethyl silicone fluids, methylphenyl silicones, amine modified silicones and the like. Such materials are commercially available in a number of forms. While it is generally preferred that an emulsified silicone be employed, non-emulsified silicones can be dissolved in a suitable solvent and incorporated in an emulsion. Polyethylenes can sometimes be employed as ironing aids and it is within the scope of this invention to use them. It is contemplated by this invention that all foaming additives and friction additives which preform as ironing aids as defined herein are contemplated for use in this invention. The most preferred ironing aid is an anionic dimethylpolysiloxane emulsion.

In general, such ironing aids are employed in amounts effective to reduce friction and to suppress foam. If excessive amounts are utilized, then the water-borne stain resistance of the film is compromised, since the emulsifiers used to disperse the siloxanes reduce surface tension and hold water to the finish.

Accordingly, from about 0.05 to 1.5% by weight of friction-reducing and antifoam additive is employed and, more preferably, from about 0.4 to 0.8% by weight is employed in the compositions of the invention.

The inventive compositions may also contain one or more of a number of optional ingredients such as perfumes, scents, optical brighteners, antistatic agents, emulsifiers, wetting agents, corrosion inhibitors, preservatives, fillers and the like.

It has also been found that the compound, urea, aids in cutting the polymer, and during ironing, helps avoid any flaking or scorching of the polymer. For these purposes, from about 0.5 to 1.5% by weight of urea is utilized.

As a filler and stabilizer it may be desirable to employ a starch in the composition. Any of the naturally occurring starches derived from corn, rice, wheat, tapioca or the like is acceptable. Modified starches and other fillers as carboxymethyl cellulose and clays can also be employed to provide additional rigidity and body to the finish, if desired. Usually, starch is employed in amounts up to about one third of the polymer concentration. Typically, starch is used in amounts from about 0.3 to 3% by weight and especially 0.3 to 1% by weight.

An aqueous carrier, such as deionized water or tap water, is employed in the balance of the composition.

Most preferably, the compositions are formulated as self-pressurized compositions which can be dispensed from pressurized containers as a wet, surface spray. If desired, the compositions can be applied by padding or can be ejected from a pump spray.

Pressurization is accomplished by adding to the compositions an inert gas, as carbon dioxide, or a liquefied, normally gaseous propellant, as a hydrocarbon or mixtures of hydrocarbons. The preferred liquefied, normally gaseous hydrocarbon propellants include propane, butane, isobutane, isopentane and mixtures thereof. Fluorinated hydrocarbons can be employed, however they are not environmentally favored. Finally, it should be kept in mind that this invention entails the use of any convenient propellent.

The amount of propellant selected is sufficient to expel the entire contents of the container holding the composition. In general, the propellant provides a wet spray, not a fine space spray. For this purpose, the propellant is preferably employed in amounts from about 3 to 10 percent by weight. An especially preferred propellant is a mixture of 20 parts propane to 80 parts isobutane.

The present composition is applied to textile materials, as cloth, fibers, yarn and the like. Fabrics made of cotton or blends of cotton and polyesters, for example 50% cotton/50% polyester and 35% cotton/65% polyester can be readily treated. In general, as long as the material preferably contains a cellulosic substrate, the present treatment can be applied, regardless of the identity of the synthetic textile material also present. The composition can also be applied to 100% synthetic materials, such as polyester.

PREPARATION EXAMPLE I

To formulate a composition of the invention a polymer of the invention, urea, starch, about half the total water to be employed and ammonia are admixed. The mixture is agitated to obtain a suspension of the insoluble materials and to dissolve the urea. The mix is then heated to from about 205°-210° F. until the polymer is solubilized. The viscosity of the mixture will first rise and, thereafter, will drop. Finally, the mix is force-cooled and the remaining water, added.

Upon complete cooling, the friction reducer and antifoaming agent, optical brightener, corrosion inhibitor, perfume and preservative are added under agitation and the resulting product, filtered.

If desired, the polymer is first prepared as a concentrated resin cut at a concentration of about 20% solids. Thereafter, the resin cut is diluted to about 3% by weight for formulation purposes. If the product is to be pressurized, the formulation is placed in a suitable container and propellant added thereto. In use, the formulation is applied by spraying onto the desired fabric in amounts generally from about 0.02 to 0.09 grams per $cm^2$ of fabric.

The following Examples represent certain preferred embodiments of the invention.

EXAMPLE 1

The following composition of the invention was prepared according to the procedure of Preparation Example I using the ingredients indicated in the recited amounts in percent by weight.

| Ingredient | Amount |
|---|---|
| [1]Terpolymer | 3.00 |
| Ammonia (28% soln) | 0.60 |
| [2]Starch | 0.70 |
| [3]Dimethylpolysiloxane emulsion | 0.45 |
| [4]Distyryl Biphenyl (optical brightener) | 0.01 |
| Urea | 1.50 |
| Formaldehyde, 37% soln. | 0.10 |
| Sodium benzoate | 0.50 |
| [5]Perfume | 0.07 |
| [6]Preservative | 0.01 |
| [7]Anti-Foam | 0.10 |
| Water | 92.96 |
| | 100.00 |

[1]The terpolymer is 25 mole percent octadecene, 25 mole percent $C_{30+}$ 1-alkene mixture and 50 mole percent maleic anhydride
[2]Penford Gum 280, a trademark of Penick Co.
[3]HV490, a trademark of Dow Chemical Co.
[4]Tinopal CBS, a trademark of Ciba-Geigy Corp.
[5]Perfume Lavendal (0.07)
[6]The preservative is Kathon MW, a trademarked product of Rohm & Haas Co.
[7]Sag 10 (0.10), a trademark of Union Carbide Corp.

EXAMPLE 2

In order to demonstrate the water resistance imparted by the fabric finishing compositions of the invention the following test procedure was utilized.

Swatches of fabric 9 by 16 inches were cut from 100% cotton material. The cotton material had been first washed five times, washed twice with detergent bleach, washed twice with detergent and then washed once without detergent at a wash water temperature from 110°-120° F.

The composition of Example 1 was placed in an aerosol can and pressurized with a mix of 20 parts propane and 80 parts isobutane in a weight ratio of 8 parts propellant to 92 parts composition.

The pressurized composition was applied to the 100% cotton swatches. Untreated swatches and swatches treated with a conventional laundry spray starch were also tested. The tests were carried out by applying water droplets from a medicine dropper to the test swatch from 4 to 6 inches from the surface. The time was then noted for the droplets to be absorbed into the fabric.

It was found that untreated swatches and starch sprayed swatches according to label directions did not impede absorption of the droplets to any significant degree. The fabric finishes of the invention, however, did provide total or at least partial water resistance, depending upon the amount sprayed, uniformity of coverage, ironing temperature and dryness of the fabric after ironing. A fabric finish solids concentration of 0.04 grams per square inch provided good water resistance and, at 0.063 grams per square inch, almost total water resistance was attained.

The more water-resistant the sample, the greater resistance to water-borne stains is exhibited.

EXAMPLE 3

The water-borne stain resistance imparted by application of the formulation of the invention was demonstrated employing the composition of Example 1.

Fabric swatches of 65/35 polyester/cotton and 100% cotton were cut into pieces approximately 9×16 inches. The swatches were initially cleaned as in Example 2. Test swatches were then sprayed with the product of Example 1 and conventional starch spray products. For control purposes, untreated swatches (nothing sprayed except for water in some cases to reduce amount of wrinkles) were also utilized.

The treated or untreated swatches of fabric were then stained with various water-borne stains such as: strong coffee, tea, red wine, liquefied grass, blood and dirt in water.

The stains were applied to the treated fabric and allowed to set overnight. In some cases the stains were dabbed-off to simulate a spill situation/incident, where the spilled material is soaked up or brushed off. The stained swatches were washed after 24 hours (or the following day). Wash conditions were 90° F. wash water temperature, one cup of detergent, medium setting and normal agitation.

Stain removal was then rated using AATCC Method 130. The finish from the product of the present invention exhibited superior water borne stain resistance compared to conventional starch products finishes, and was far superior to untreated fabrics.

EXAMPLE 4

The composition of Example 1 was applied to textile fabrics and evaluated in accordance with AATCC Test Method 128-1980 to test wrinkle resistance. That procedure was modified such that the humidity chamber was at 35° C. at 60% RH and the samples were conditioned for ½ to ¾ hours before running the Procedure steps.

The results showed at least similar wrinkle-resistance to starched products. In addition, visual observations of actual wear wrinkle resistance on cotton shirts treated in accordance with the procedure of Example 1 illustrated very significant enhancement of wrinkle resistance with the finishes from the composition of the invention.

This invention is not to limited except as set forth in the following claims.

What is claimed is:

1. An aqueous fabric finishing composition comprising a solublized polymer of from (a) 40 to 51 mole percent of at least one higher 1-alkene having a carbon content of $C_{10}$ to $C_{18}$ and $C_{20}$ to $C_{30+}$ and from (b) about 60 to 49 mole percent maleic anhydride, said composition being adapted to be applied to fabrics and affixed thereto under heat and pressure, and (c) an additive to reduce friction of said composition after application to fabrics and to reduce the foaming tendency of said composition on application to fabrics.

2. The composition of claim 1 including a siloxane resin emulsion.

3. The composition of claim 2 in which the siloxane resin emulsion is a dimethylpolysiloxane resin emulsion.

4. The composition of claim 1 in which the additive is present in amounts from 0.05 to 1.5% by weight based on the total weight of the composition.

5. The composition of claim 1 including urea in amounts from about 0.5 to 1.5% by weight based on the total weight of the composition.

6. The composition of claim 1 including a starch in amounts from about 0.3 to 3% by weight based on the total weight of the composition.

7. The composition of claim 1 including a propellant to render the composition self-propelled.

* * * * *